US006116969A

United States Patent [19]

Piriz

[11] Patent Number: 6,116,969

[45] Date of Patent: Sep. 12, 2000

[54] CABLE CONNECTOR

[75] Inventor: Jose M. Piriz, Collierville, Tenn.

[73] Assignee: Thomas & Betts International, Inc., Sparks, Nev.

[21] Appl. No.: 09/138,507

[22] Filed: Aug. 24, 1998

Related U.S. Application Data

[60] Provisional application No. 60/057,748, Aug. 26, 1997.

[51] Int. Cl.[7] ..... H01R 4/50; H01R 11/01

[52] U.S. Cl. ..... 439/783; 439/781

[58] Field of Search ..... 439/783, 781, 439/863, 784, 785, 805; 29/877.35, 882

[56] References Cited

U.S. PATENT DOCUMENTS

| | | | |
|---|---|---|---|
| 568,802 | 11/1896 | Seaman . | |
| 600,636 | 3/1898 | Curry . | |
| 667,530 | 2/1901 | Johnson . | |
| 788,357 | 4/1905 | Hulsey . | |
| 1,888,342 | 11/1932 | Anderson . | |
| 2,106,724 | 2/1938 | Cope . | |
| 2,450,147 | 9/1948 | Lawry . | |
| 2,469,257 | 5/1949 | Brickman . | |
| 2,814,025 | 11/1957 | Wade et al. . | |
| 2,828,147 | 3/1958 | Peiffer . | |
| 3,065,449 | 11/1962 | Matthyssee et al. . | |
| 3,275,974 | 9/1966 | Mixon, Jr. . | |
| 3,329,928 | 7/1967 | Broske . | |
| 3,462,543 | 8/1969 | Wahl et al. . | |
| 3,504,332 | 3/1970 | Mixon, Jr. . | |
| 3,516,050 | 6/1970 | Mixon et al. . | |
| 3,588,791 | 6/1971 | Plidori . | |
| 3,920,310 | 11/1975 | Walsh et al. . | |
| 4,059,333 | 11/1977 | Mixon, Jr. . | |
| 4,533,205 | 8/1985 | Frank . | |
| 4,600,264 | 7/1986 | Counsel . | |
| 4,634,205 | 1/1987 | Gemra . | |
| 4,650,273 | 3/1987 | Roosdrop . | |
| 4,723,920 | 2/1988 | Werner . | |
| 4,730,087 | 3/1988 | Werner . | |
| 4,734,062 | 3/1988 | Goto . | |
| 4,813,894 | 3/1989 | Mixon, Jr. . | |
| 4,863,403 | 9/1989 | Shannon . | |
| 4,872,856 | 10/1989 | Pooley et al. . | |
| 4,915,653 | 4/1990 | Mair | 439/781 |
| 5,006,081 | 4/1991 | Counsel et al. . | |
| 5,044,996 | 9/1991 | Goto | 439/783 |
| 5,145,420 | 9/1992 | Counsel et al. . | |
| 5,244,422 | 9/1993 | Laricchia . | |
| 5,257,948 | 11/1993 | Peterson | 439/571 |
| 5,538,447 | 7/1996 | Chadbourne et al. . | |
| 5,613,883 | 3/1997 | Chadbourne et al. | 439/783 |
| 5,679,031 | 10/1997 | Chadbourne et al. | 439/783 |
| 5,774,987 | 7/1998 | Chadbourne et al. . | |
| 5,794,334 | 8/1998 | Chadbourne et al. . | |
| 5,816,865 | 10/1998 | Chadbourne | 439/783 |
| 5,830,019 | 11/1998 | Chadbourne et al. . | |
| 5,842,893 | 12/1998 | Keyser | 439/783 |
| 5,862,589 | 1/1999 | Chadbourne et al. | 29/882 |
| 5,868,588 | 2/1999 | Chadbourne et al. | 439/783 |

*Primary Examiner*—Lincoln Donovan
*Assistant Examiner*—Chandrika Prasad
*Attorney, Agent, or Firm*—Hoffmann & Baron, LLP

[57] ABSTRACT

An electrical connector for connecting a pair of electrical conductors in electrically conductive and mechanical engagement includes an elongate conductive body having a generally planar face and which defines a pair of spaced-apart inwardly directed cable receiving nests for accommodating the electrical conductors in spaced apart parallel relationship. The body has an open face opposite the planar face between the cable receiving nests. The connector also includes a wedge having a first end, a second end, and an elongate wedge body therebetween. The wedge is insertable through the open face between the cable receiving nests for removable engagement with the planar face so as to retentatively urge the electrical conductors into the cable receiving nests.

19 Claims, 8 Drawing Sheets

CABLE CONNECTOR

This application claims the benefit of U.S. Provisional application Ser. No. 60/057,748, filed on Aug. 26, 1997.

FIELD OF THE INVENTION

The present invention relates generally to wedge-type connectors for connecting electrical conductor cables. More particularly the present invention relates to a cable connector which does not require a specialized tool.

BACKGROUND OF THE INVENTION

Wedge connectors for connecting together two or more electrical conductors are well-known. Wedge connectors typically include an elongate conductive body or sleeve having a generally C-shaped cross-section and accommodate a pair of stripped electrical conductors in parallel alignment within a pair of opposed individual connector nests defined by the opposed curved surfaces of the sleeve. Many wedge connectors maintain the cables within their respective nests by inserting a wedge member between therebetween within the expanse of the sleeve along a line extending substantially parallel to the cables. These wedges rely on a compressive force against each cable to maintain the conductive contact between the sleeve and the cables and may become disengaged from the sleeve due to vibration. Also, properly assembled, these connectors may require extreme force to separate should it be desired to disassemble the connection. Other wedge connectors provide for removably securing a wedge to the sleeve by inserting a multi-component fastener transversely through the wedge and the sleeve to positively maintain the connection. Furthermore, many of the wedge connectors of the prior art require a specialized tool to establish the conductive connection which becomes an additional burden to the electrician installing the connectors.

For example, U.S. Pat. No. 5,538,447 discloses a wedge connector including a generally C-shaped conductive sleeve where the wedge includes a pair of elongate cable engaging members transversely spaced by a number of elongate C-shaped spring elements. The cable engaging members each provide a curved cable engaging surface for urging the cables into their respective nests on the sleeve. In addition to relying on the frictional fit between the wedge and the cables, the sleeve of the '447 patent includes a projecting tap which abuts against one of the spring elements adjacent the wider expanse between the nests for retaining the wedge therein. In order for the wedge to be transversely inserted between the cables within the sleeve the spring elements must be compressed beyond the what is required to engage the cables. Once the compressive force on the springs is released, the springs expand to urge the cables into their respective nests. Because the springs buckle outward when compressed, over-compression of the springs may cause the springs to buckle beyond the transverse extent of the cable engaging members and interfere with inserting the wedge within the sleeve expanse. Thus, while providing a traditional retention mechanism, the wedge connector of the '447 patent may be too difficult to insert in certain environments without specialized tools. Additionally, the connector of the '447 patent provides no easy means for disassembly once the wedge is inserted into the sleeve.

U.S. Pat. No. 4,723,920, on the other hand, provides an elongate C-shaped conductive sleeve and an elongate wedge member including a pair of toggle blocks pivotally hinged together so that the wedge may be transversely inserted into the sleeve expanse in a slightly folded configuration. The toggle blocks define a central opening therebetween and the hinge supports a hinge pin therethrough. The hinge pin is received through one end of a threaded bolt which transversely extends from the central opening for insertion through a through-hole in the sleeve. A nut is threaded over the bolt on the opposite side of the sleeve from the wedge so that continued threading of the nut over the bolt extends the opposed edges of the toggle blocks further into the cable nests so as compress the cables therein. While the wedge of the '920 patent does not require a specialized tool, its requires many parts and the electrician must have enough room around the sleeve to properly manipulate the nut over the bolt during assembly and disassembly.

It is therefore desirable to provide a electrical connector for connecting a pair of electrical conductors which provides a simple positive removable connection between a transversely insertable wedge and a conductive sleeve without requiring a specialized tool.

SUMMARY OF THE INVENTION

It is an object of the present invention to provide an electrical connector for connecting a pair of electrical conductors.

It is another object of the present invention to provide an electrical connector for connecting a pair of electrical conductors which does not require a special tool for assembly.

It is another object of the present invention to provide an electrical connector for connecting a pair of electrical conductors which may be assembled using tools commonly carried by an electrician.

In the efficient attainment of these and other objects, the present invention provides an electrical connector for connecting a pair of electrical conductors in electrically conductive and mechanical engagement which includes an elongate conductive body having a generally planar face and which defines a pair of spaced-apart inwardly directed cable receiving nests for accommodating the electrical conductors in spaced apart parallel relationship. The body has an open face opposite the planar face between the cable receiving nests. The connector further includes a wedge having a first end, a second end, and an elongate wedge body therebetween. The wedge is insertable through the open face between the cable receiving nests for removable engagement with the planar face so as to urge the electrical conductors within the cable receiving nests.

The present invention will be more readily appreciated in a reading of the "Detailed Description of the Preferred Embodiments" with reference to the following drawings.

DETAILED DESCRIPTION OF THE PREFERRED EMBODIMENT

Figure 1:
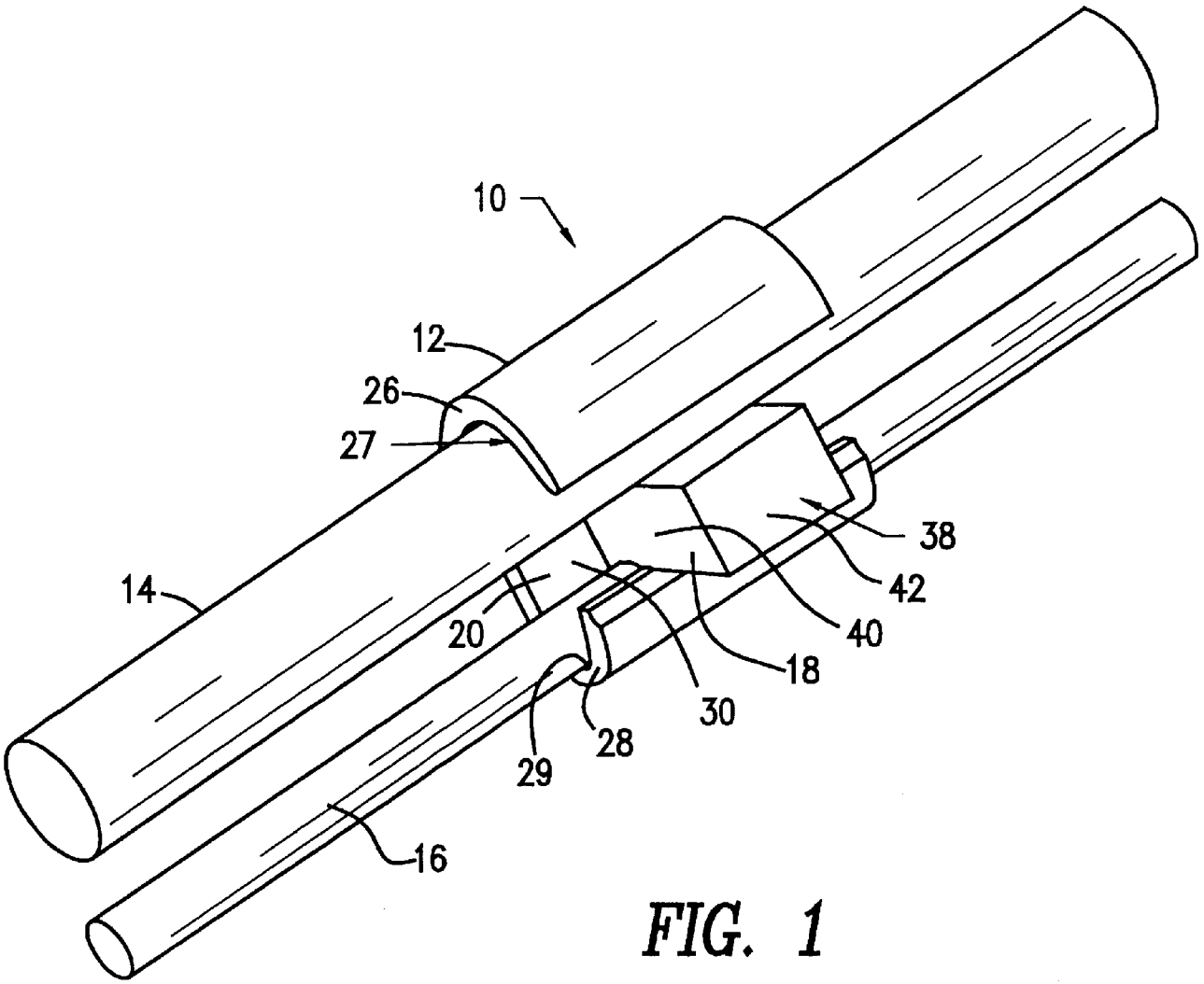
FIG. 1 is a perspective view of the electrical connector of the present invention prior to assembly.
Figure 2:
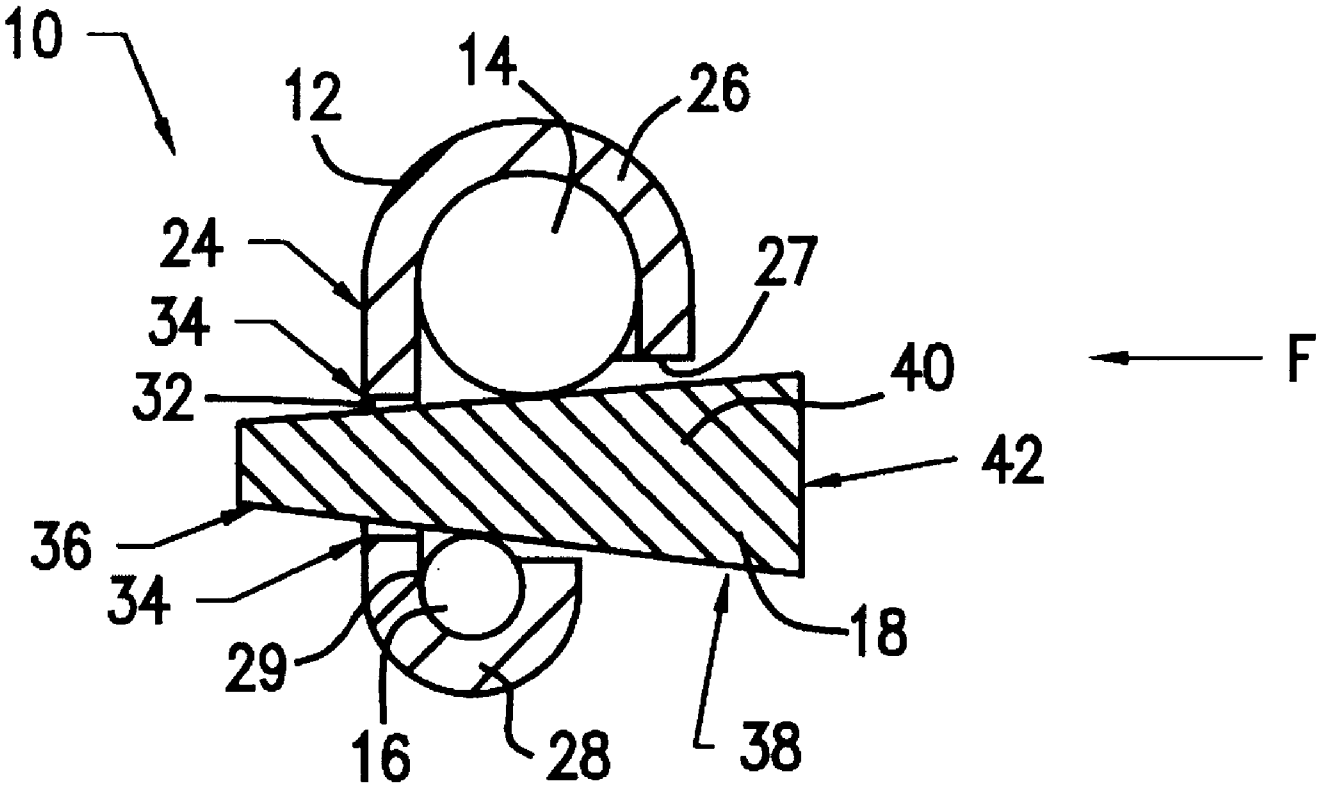
FIG. 2 is a perspective view of the electrical connector of FIG. 1 in an assembled configuration.
Figure 3:
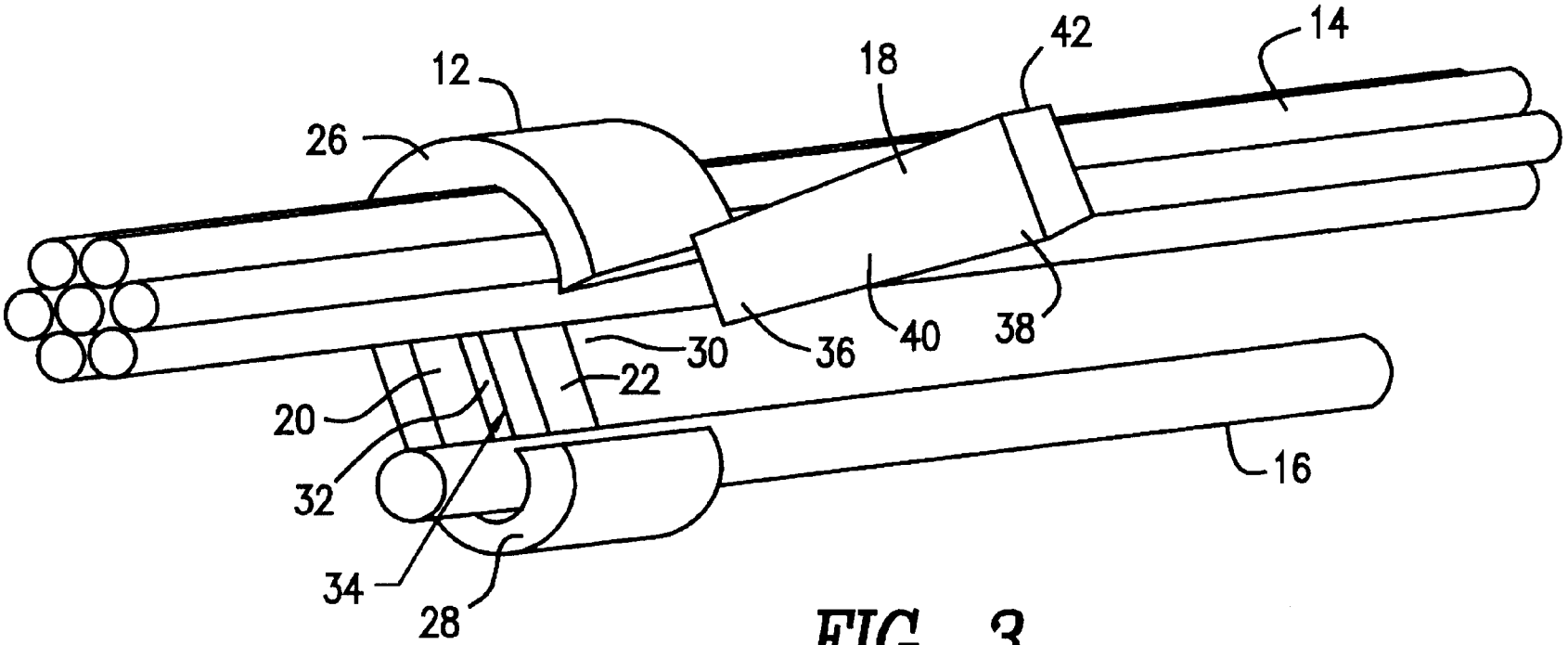
FIG. 3 is a side elevational view, partially in section, showing the electrical connector of FIG. 1 in the assembled configuration.
Figure 5:
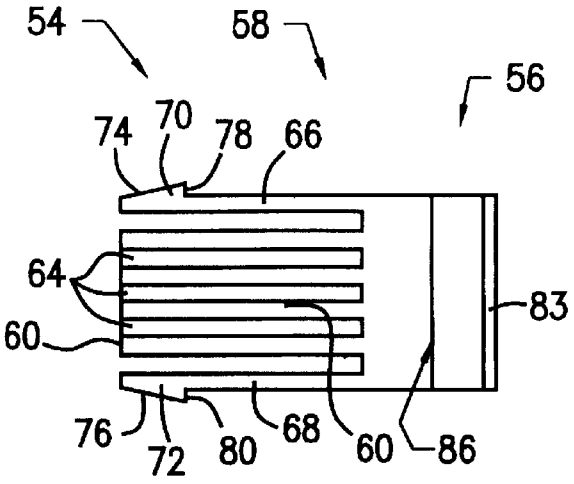
FIG. 5 is a front elevational view of the locking wedge of the electrical connector of FIG. 4.
Figure 6:
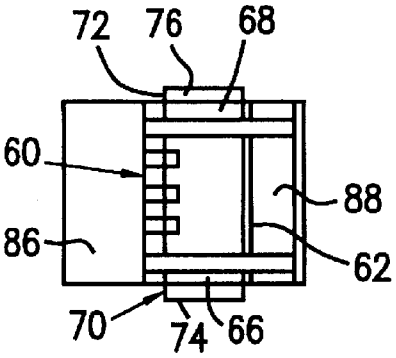
FIG. 6 is a top view of the locking wedge of FIG. 5.
Figure 4:
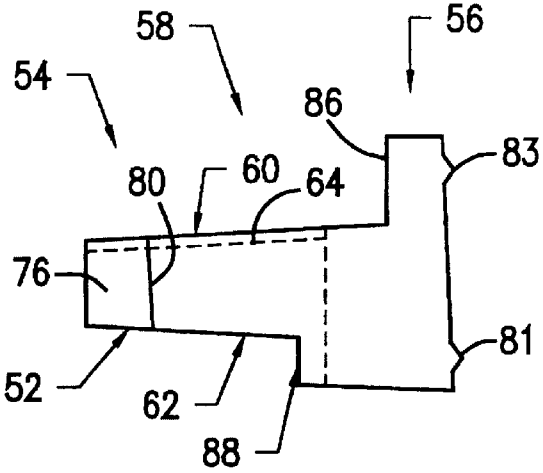
FIG. 4 is a perspective view of an alternate embodiment of the electrical connector of the present invention in the assembled configuration.
Figure 7:
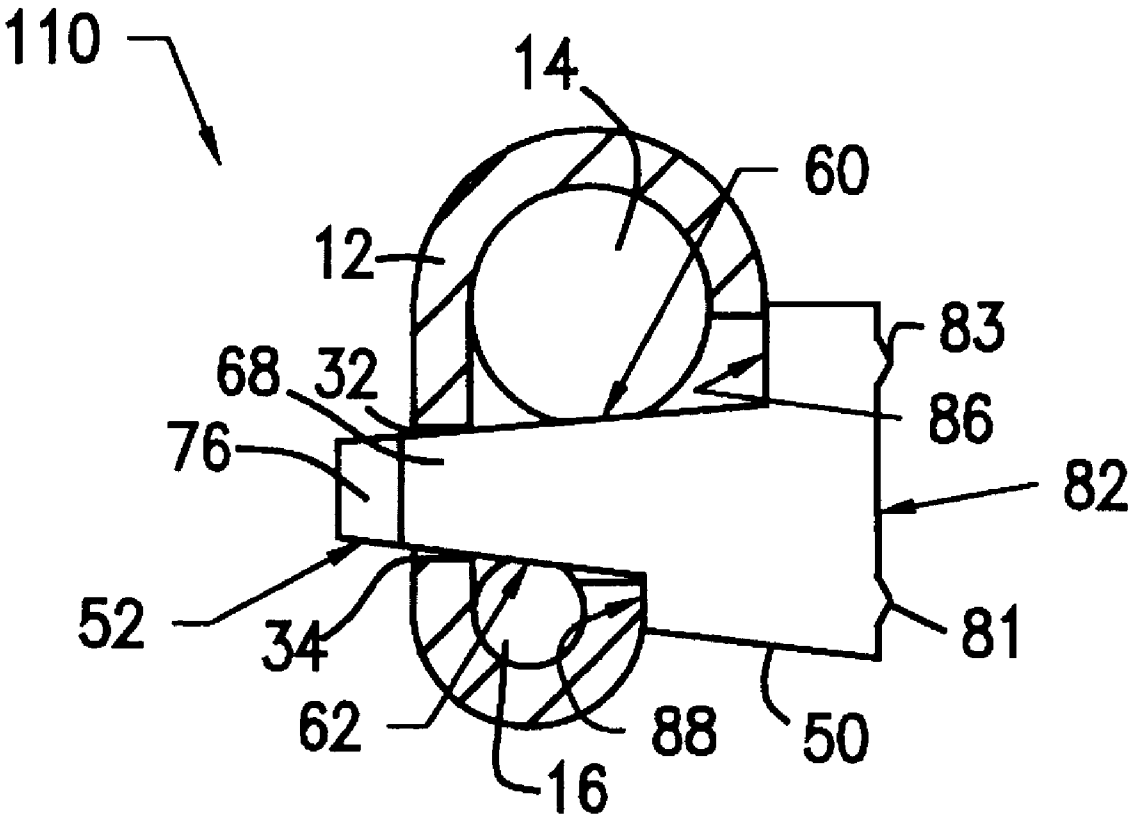
FIG. 7 is a side elevational view of the locking wedge of FIG. 5.
Figure 8:
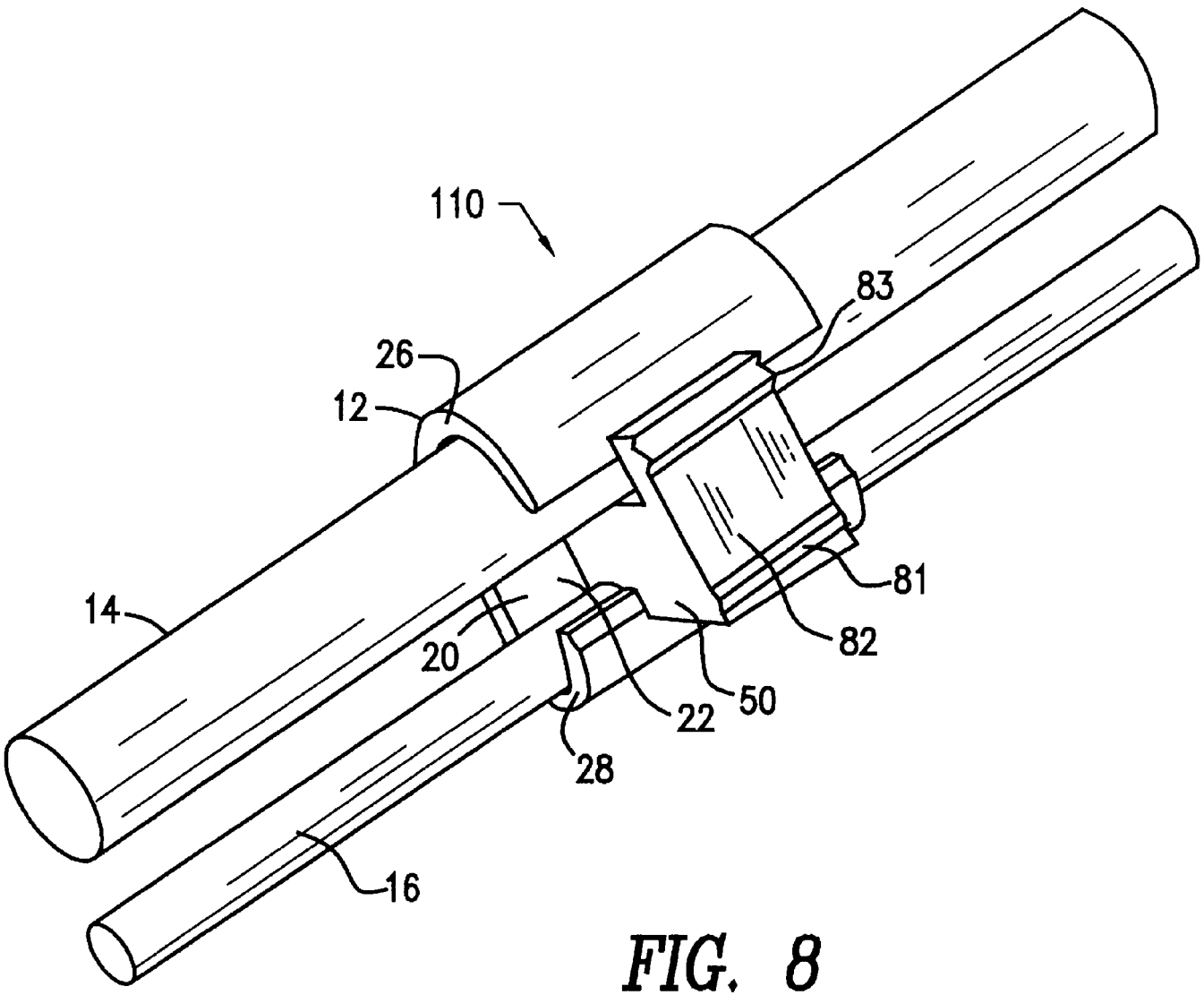
FIG. 8 is a side elevational view of the electrical connector of FIG. 4 in the assembled configuration.
Figure 10:
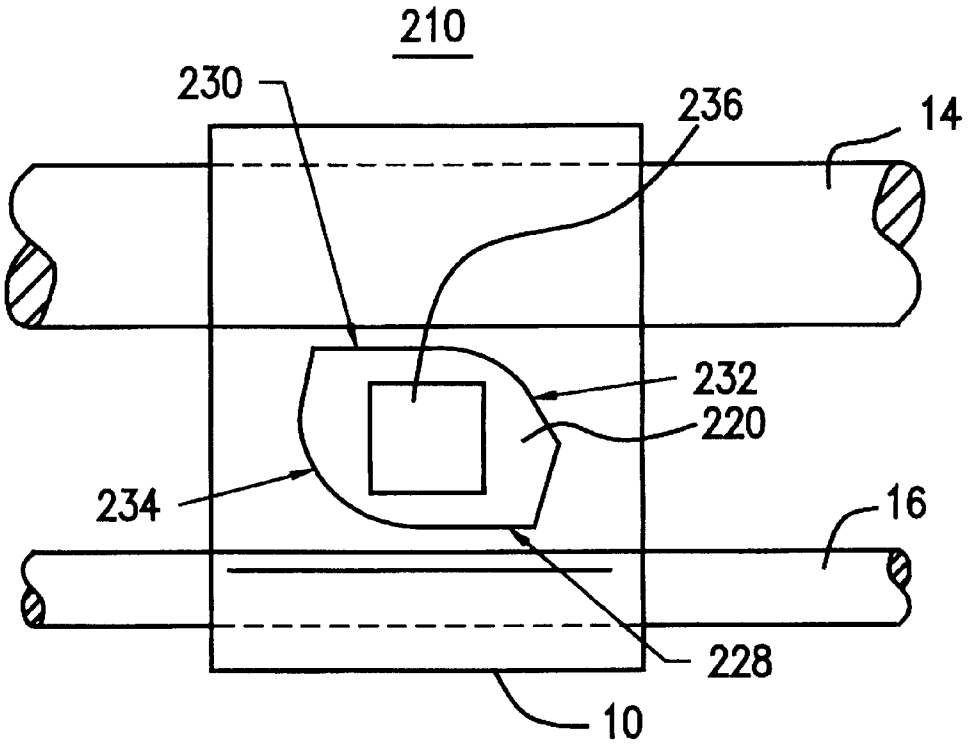
FIG. 10 is a front elevational view of the electrical connector of FIG. 9 in the assemble but unlocked configuration.
Figure 9:
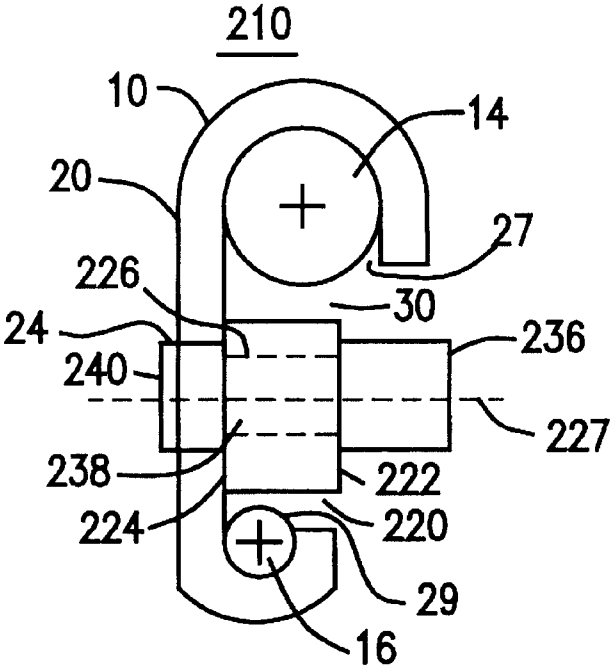
FIG. 9 is a side elevational view of another embodiment of an electrical connector of the present invention in the assembled but unlocked configuration.
Figure 12:
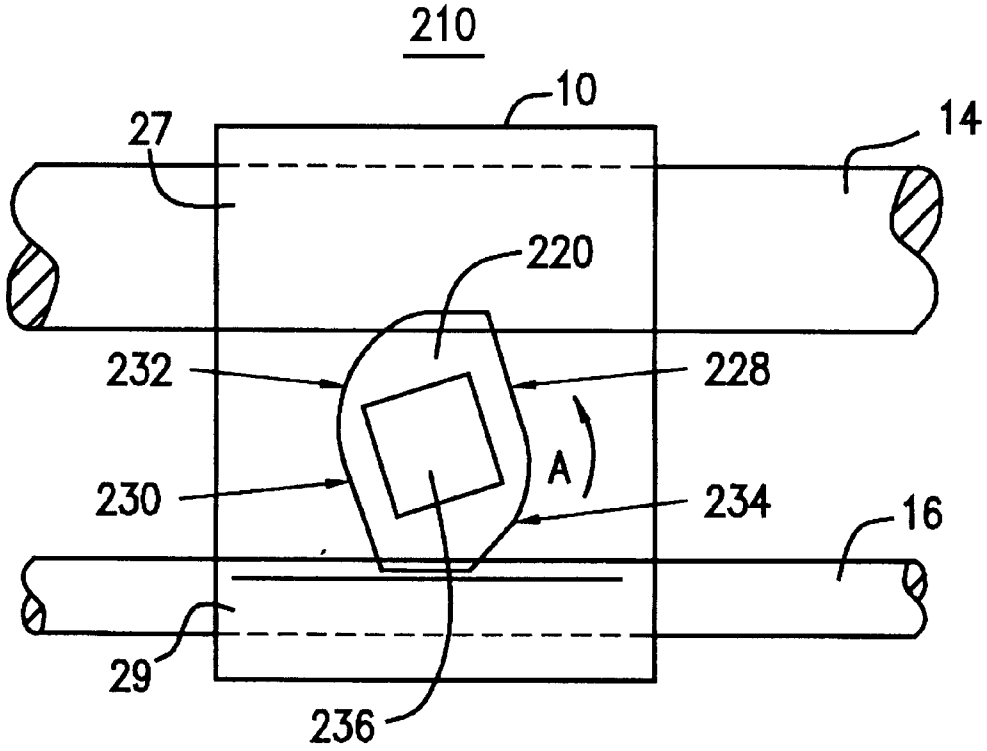
FIG. 12 is a front elevational view of the electrical connector of FIG. 9 in the assemble and locked configuration.
Figure 11:
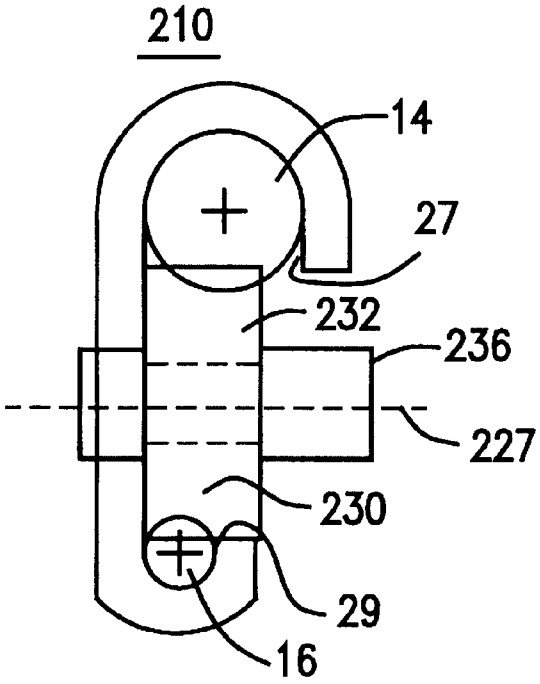
FIG. 11 is a side elevational view, partially in section, of the electrical connector of FIG. 9 in the assembled and locked configuration.

Referring to FIGS. 1–3, a compression connector 10 of the present invention is shown. Connector 10 includes an elongate conductive body or sleeve 12 for retaining a pair of electrical conductor cables 14 and 16 in conductive engagement with an elongate connector wedge 18 which is driven perpendicular to the axis of cables 14 and 16. As may be appreciated, the size and shape of connector 10 may be varied to accommodate various lengths and thicknesses (diameters) of cable. Sleeve 12 and wedge 18 are formed of a suitably conductive metal such as copper and are formed using conventional techniques. While copper is selected as the preferable material for its high electrical conductivity, it is understood that other conductive metals such as aluminum may also be used to form the connector of the present invention. Connector 10 may be manufactured using less material than, and thus may be formed smaller than existing connectors which depend on frictional engagement between the cables and the wedge to maintain the conductive connection. The small size also allows the connector to be installed using common hand tools such as pliers, channel locks, and the like.

Sleeve 12 includes an elongate planar wall 20 having a first major surface 22 and an opposed second major surface 24. Planar wall 20 includes first and second elongate cable support members 26 and 28 in facing opposition thereacross so as to define a sleeve expanse for receiving cables 14 and 16. Cable support members 26 and 28 are desirably arcuately shaped and define first and second cable receiving nests 27 and 29. Cable receiving nests 27 and 29 are shown as having been formed having disparate dimensions for accommodating conductor cables of different diameters in parallel spaced-apart relationship. It is of course contemplated by the present invention that cable receiving nests 27 and 29 may alternatively be formed having approximately equal dimensions as well as having a converging longitudinal alignment. Planar wall 20 includes a wedge insertion aperture 32 communicating between first and second major surfaces 22 and 24 in registry with an open sleeve expanse 30 defined between spaced-apart cable support members 26 and 28. Wedge insertion aperture 32 is defined by a perimetrical retaining rim 34 thereabout which as will be described in detail hereinbelow provides for removable retention of wedge 18.

Wedge 18 includes a narrow first end 36, an opposed wider second end 38, and an elongate tapering wedge-shaped body 40 therebetween. First end 36 is received in and is removably frictionally retained by retaining rim 34 so as to position wedge body 40 within sleeve expanse 30 to thereby retentatively urge cables 14 and 16 into conductive engagement with first and second cable support members 26 and 28, respectively. Wedge 18 also includes a head surface 42 to be acted upon by an insertion force F. A user may install wedge 18 into sleeve 12 by engaging major surface 24 of sleeve 12 and head surface 42 of wedge 18 with the opposed jaw members of conventional pliers (not shown). Wedge body 40 bottoms on retaining rim 34 in interfering engagement. Wedge 18 may be disassembled without damaging conductors 14 and 16 and reused if desired.

Referring to FIGS. 4–8, an alternate embodiment of the present invention provides a connector 110 including conductive sleeve 12 and an elongate wedge 50 of modified construction for positively engaging retaining rim 34 of sleeve 12. Wedge 50 includes a first end 54, an opposed second end 56 and an elongate wedge-shaped body 58 therebetween. Wedge body 58 include an upper wedge surface 60 and a lower wedge surface 62 in tapering alignment therewith. Wedge surface 60 defines a number of longitudinal channels 64 for enhanced cable-gripping engagement. Wedge body 58 also supports transversely-spaced first and second elongate deflectable locking arms 66 and 68 forming a releasable locking element. Each of locking arms 66 and 68 support a fixed locking tooth 70 and 72, respectively, extending in transverse-spaced facing opposition. Each locking of locking teeth 70 and 72 include a tapering tooth face 74 and 76 and a transverse rim engaging face 78 and 80, respectively.

Second end 56 of wedge 50 desirably includes an enlarged planar head surface 82 to be acted upon by an insertion force F. A user may install wedge 50 into sleeve 12 by engaging major surface 24 of sleeve 12 and head surface 82 of wedge 18 with the opposed jaw members of conventional pliers (not shown). Head surface 82 includes a number of elongate positioning teeth 81 and 83 for engaging jaw members of the pliers to thereby prevent slippage of the pliers during connector assembly. It is also contemplated by the present invention that wedge 50 includes a first and second transverse wedge surface 86 and 88 for engaging first and second cable support members 26 and 28 in the assembled configuration. Transverse wedge surfaces 86 and 88 are formed projecting from longitudinally distinct locations from wedge body 58. When cable support members 26 and 28 are formed having the same dimensions, the present invention contemplates providing first and second transverse wedge surfaces 86 and 88 as extending in substantially coplanar alignment.

During assembly of connector 110, the user positions cables 14 and 16 in cable receiving nests 27 and 29 respectively and then inserts first end 54 of wedge 50 through sleeve expanse 30 and wedge insertion aperture 32. As first end of wedge 50 is inserted through wedge insertion aperture 32, tapering tooth faces 74 and 76 engage retaining rim 34 and cause locking arms 66 and 68 to cantileverly deflect from an undeflected position towards wedge body 58. Once tapering tooth faces 74 and 78 have been inserted past retaining rim 34, locking arms are free to deflect back towards the undeflected position so as to position rim engaging faces 78 and 80 in abutting engagement with retaining rim 34 and thereby maintain wedge 50 therein. Tapering upper and lower wedge surfaces 60 and 62 thereby urge and retain cables 14 and 16 within cable receiving nests 27 and 29.

The location of transverse wedge surfaces 86 and 88 opposite locking element 52 and in facing opposition to major surface 20 assures the required pressure over cables 14 and 16 and a reliable connection. Wedge 50 may be disassembled from sleeve 12 by deflecting locking teeth 70 and 72 towards wedge body 58 and withdrawing wedge 50 back through sleeve expanse 30. Connector 110 may then be reused or reassemble over the same cables 14 and 16.

Referring now to FIGS. 9–12, an alternate embodiment of the present invention provides a cable connector 210 including conductive sleeve 12 and a locking nut 220 rotatably supported within sleeve expanse 30. Locking nut 220 includes opposed first and second major surfaces 222 and 224 and an elongate cylindrical nut passageway 226, shown by phantom lines in FIGS. 9 and 11, communicating therebetween. Nut passageway 226 defines a coaxial nut rotation axis 227 extending substantially perpendicularly to major surfaces 222 and 224. Locking nut 220 further includes first and second transversely-spaced planar edgefaces 228 and 230 and first and second transversely-spaced cam surfaces 232 and 234.

Locking nut 220 is rotatably supported within sleeve expanse 30 by a rotation member 236 including a central portion 238 extending through nut passageway 226 and a first end 240 fixedly engaging retaining rim 34 of planar wall 20. Central portion 238 is formed to allow locking nut 220 to rotate about rotation axis 227. It is contemplated by the present invention that first end 240 of rotation member 236 fixedly engages retaining rim 34 by means well-known in the art for supporting an elongate member within an aperture.

Planar edgefaces 228 and 230 define a first transverse dimension allowing locking nut 220 to be inserted between first and second cables 14 and 16 positioned within cable-receiving nests 27 and 29. Cam surfaces 232 and 234 define a second transverse dimension greater than the spacing between cables 14 and 16 across sleeve expanse 30. Upon rotation of locking nut 220 about axis 227 in the direction of arrow A, cam surfaces 232 and 234 retentatively urge cables 14 and 16 into, and maintain cables 14 and 15 within, cable receiving nests 27 and 29. Cam surfaces 232 and 234 thereby provide positive retention of cables 14 and 16 in conductive engagement with sleeve 12. Connector 210 may be disassembled by rotating locking nut 220 in the direction opposite to arrow A so as to disengage cam surfaces 232 and 234 from cables 14 and 16.

While the preferred embodiment of the present invention has been shown and described, it will be obvious in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical connector for connecting a pair of electrical conductors comprising:

an elongate conductive body having a generally planar face and defining a pair of spaced-apart inwardly directed cable receiving nests for accommodating said electrical conductors in spaced apart parallel relationship, said body having an open face opposite said planar face between said cable receiving nests and said planar face defining a connector insertion aperture; and a wedge having a first end, a second end, and an elongate wedge-shaped body therebetween, said wedge being insertable through said open face between said cable receiving nests and into said connector insertion aperture in a direction substantially normal to said planar face for removable retentive engagement with said conductive body so as to retentatively urge said electrical conductors into said cable receiving nests for conductive engagement with said body.

2. The cable connector of claim 1, wherein said conductive body includes a wedge insertion aperture through said planar face defining a wedge retaining rim for receiving said first end of said wedge in removable locking engagement.

3. The cable connector of claim 2, wherein said first end of said wedge includes a first deflectable locking tooth and a second deflectable locking tooth in facing opposition to said first deflectable locking tooth for releasable locking engagement with said wedge retaining rim when said first end of said wedge is inserted through said connector insertion aperture.

4. The cable connector of claim 3, wherein said second end of said wedge supports a transverse wedge component including a first and a second transverse wedge surface in facing opposition to said planar portion of said conductive body when said first end of said wedge is inserted through said connector insertion aperture.

5. The cable connector of claim 4, wherein said first transverse wedge surface engages said conductive body adjacent one of said pair of said cable receiving nests and said second transverse wedge surface engages said conductive body adjacent the other of said pair of cable receiving nests when said first end of said wedge is inserted through said connector insertion aperture.

6. The cable connector of claim 5, wherein said second end of said wedge further includes a head surface in facing opposition to said first and second transverse wedge surfaces.

7. An electrical connector for connecting a pair of electrical cables comprising:

an elongate conductive sleeve including an elongate planar portion having a first major surface and an opposed second major surface, said planar portion supporting first and second elongate cable support members in facing opposition across said planar portion so as to define a cable receiving space therebetween, said planar portion defining a connector insertion aperture located between said first and second cable support members communicating with said cable receiving space; and an elongate wedge having a first end, an opposed second end, and an elongate wedge body therebetween, said wedge being removably insertable into said cable receiving space in a direction substantially normal to said first major surface, said first end removably lockingly received in said connector insertion aperture so as to position said wedge body between said first and second cable support members whereby said wedge body retentatively urges a first cable into conductive engagement with said first cable support member and a second cable into conductive engagement said second cable support member.

8. The cable connector of claim 7, wherein said planar portion includes a wedge retaining rim defining said wedge insertion aperture and wherein said first end of said wedge includes a first deflectable locking tooth for releasable locking engagement with said wedge retaining rim when said first end of said wedge is inserted through said connector insertion aperture.

9. The cable connector of claim 8, wherein said wedge includes a second deflectable locking tooth in facing opposition to said first deflectable locking tooth for releasable locking engagement with said wedge retaining rim when said first end of said wedge is inserted through said connector insertion aperture.

10. The cable connector of claim 8, wherein said second end of said wedge supports a transverse wedge component including a first transverse wedge surface in facing opposition to said planar portion of said sleeve when said first end of said wedge is inserted through said connector insertion aperture.

11. The cable connector of claim 10 wherein said first transverse wedge surface engages said first cable support member when said first end of said wedge is inserted through said wedge insertion aperture.

12. The cable connector of claim 10, wherein said second end of said transverse wedge component includes a second transverse wedge surface in facing opposition to said planar portion of said sleeve when said first end of said wedge is inserted through said wedge insertion aperture.

13. The cable connector of claim 12, wherein said second transverse wedge surface engages said first cable support member when said first end of said wedge is inserted through said wedge insertion aperture.

14. The cable connector of claim 10, wherein said second end of said wedge further includes a head surface in facing opposition to said first and second transverse wedge surfaces.

15. The cable connector of claim 14, wherein said head surface supports an elongate gripping rib.

16. The cable connector of claim 7, wherein said sleeve includes a generally C-shaped cross section whereby said first cable support member defines an arcuate first cable support surface in facing opposition to said second cable support member.

17. The cable connector of claim 7, wherein said second cable support member defines an arcuate second cable support surface in facing opposition to said first cable support surface.

18. The cable connector of claim 17, wherein said second cable support surface is defined by a smaller radius of curvature than said first cable support surface.

19. The cable connector of claim 14, wherein said first and second transverse wedge taper with respect to said wedge body.

* * * * *